US006846097B1

(12) United States Patent
Strawn

(10) Patent No.: US 6,846,097 B1
(45) Date of Patent: Jan. 25, 2005

(54) LIGHT STRING WITH PERSONALIZABLE LIGHT COVERS

(75) Inventor: Wanda Strawn, Lake Forest, CA (US)

(73) Assignee: Wanda Strawn Swack Enterprises, Inc., Lake Forest, CA (US)

( * ) Notice: Subject to any disclaimer, the term of this patent is extended or adjusted under 35 U.S.C. 154(b) by 0 days.

(21) Appl. No.: 10/634,412

(22) Filed: Aug. 4, 2003

Related U.S. Application Data

(60) Provisional application No. 60/402,103, filed on Aug. 8, 2002.

(51) Int. Cl.[7] ..... F21V 29/00; F21S 4/00

(52) U.S. Cl. ..... 362/294; 362/311; 362/249; 40/575

(58) Field of Search ..... 362/391, 227, 362/249, 374, 311, 367, 252, 294, 373, 376–378, 456; 40/574–575, 491

(56) References Cited

U.S. PATENT DOCUMENTS

| | | | | | |
|---|---|---|---|---|---|
| 3,461,283 | A | * | 8/1969 | Richard | 362/294 |
| 3,767,913 | A | * | 10/1973 | Trevithick | 362/378 |
| 3,849,640 | A | * | 11/1974 | McCarthy | 362/437 |
| 4,679,126 | A | * | 7/1987 | Van Sickler | 362/226 |
| 4,841,420 | A | * | 6/1989 | Baggio et al. | 362/249 |
| 5,513,084 | A | * | 4/1996 | Simpson | 362/284 |
| 6,648,498 | B1 | * | 11/2003 | Tsao | 362/235 |
| 2002/0144441 | A1 | * | 10/2002 | Zentmire et al. | 40/575 |

* cited by examiner

*Primary Examiner*—Alan Cariaso
*Assistant Examiner*—Ali Alavi

(57) ABSTRACT

A light string with personalizable light covers. The light string includes multiple individual light bulb assemblies each including a light bulb electrically connected to a light bulb socket and having a light bulb housing secured over each light bulb assembly. The light bulb housings each have a slide out bottom panel provided with airflow apertures therethrough for allowing cooling of the housing as well as allowing replacement of the light bulb therein as needed and also have a three sided, picture frame style transparency holder.

1 Claim, 3 Drawing Sheets

LIGHT STRING WITH PERSONALIZABLE LIGHT COVERS

This application claims the benefit of provisional application 60/402,103 filed Aug. 8, 2002.

TECHNICAL FIELD

The present invention relates to decorative light strings and more particularly to a light string with personalizable light covers that includes a string of lights having multiple individual light bulb assemblies each including a light bulb electrically connected to a light bulb socket; a light bulb housing secured over each light bulb assembly adapted to have a slide out bottom panel provided with airflow apertures therethrough for allowing cooling of the housing as well as allowing replacement of the light bulb therein as needed and having a transparency holder adapted for holding a transparency such that light emitted from the light bulb causes a transparency held in the transparency holder to be illuminated.

BACKGROUND ART

Strings of light are often used to decorate for special occasions. It would be desirable, therefore, to have a light string system that could be personalized each time it is used for a special occasion.

GENERAL SUMMARY DISCUSSION OF INVENTION

It is thus an object of the invention to provide a light string with personalizable light covers that includes a string of lights having multiple individual light bulb assemblies each including a light bulb electrically connected to a light bulb socket; a light bulb housing secured over each light bulb assembly adapted to have a slide out bottom panel provided with airflow apertures therethrough for allowing cooling of the housing as well as allowing replacement of the light bulb therein as needed and having a transparency holder adapted for holding a transparency such that light emitted from the light bulb causes a transparency held in the transparency holder to be illuminated.

Accordingly, a light string with personalizable light covers is provided. The light string with personalizable light covers includes a string of lights having multiple individual light bulb assemblies each including a light bulb electrically connected to a light bulb socket; a light bulb housing secured over each light bulb assembly adapted to have a slide out bottom panel provided with airflow apertures therethrough for allowing cooling of the housing as well as allowing replacement of the light bulb therein as needed and having a transparency holder adapted for holding a transparency such that light emitted from the light bulb causes a transparency held in the transparency holder to be illuminated.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figures 1, 2:
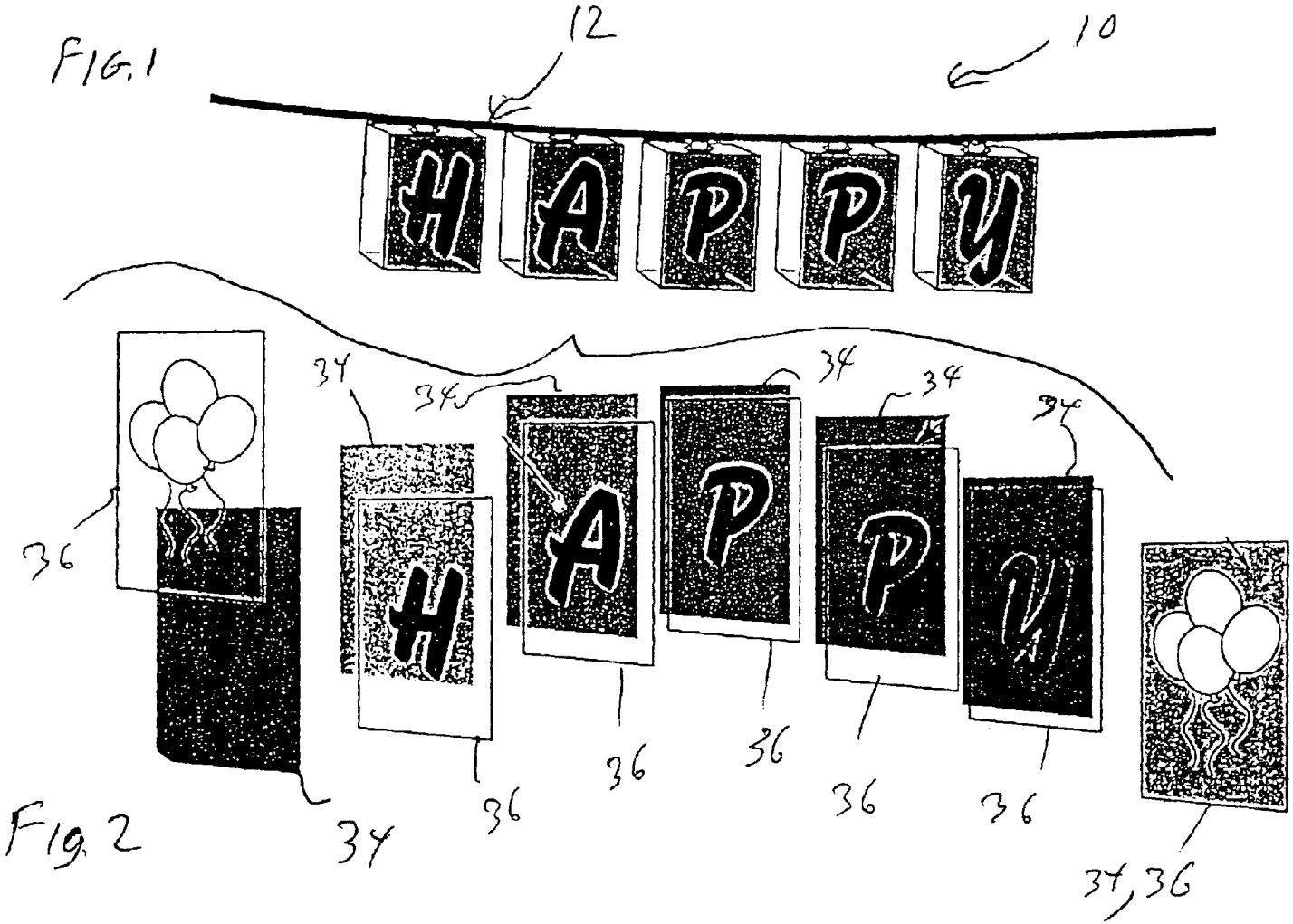
FIG. 1 is a perspective view of an exemplary embodiment of the light string with personalizable light covers of the present invention.
FIG. 2 is a perspective view of representative transparencies used with the light string with personalizable light covers of FIG. 1 including color background transparencies and decorative transparencies, such as a letter or a festive items, adapted to be used with the color background transparencies.
Figure 3:
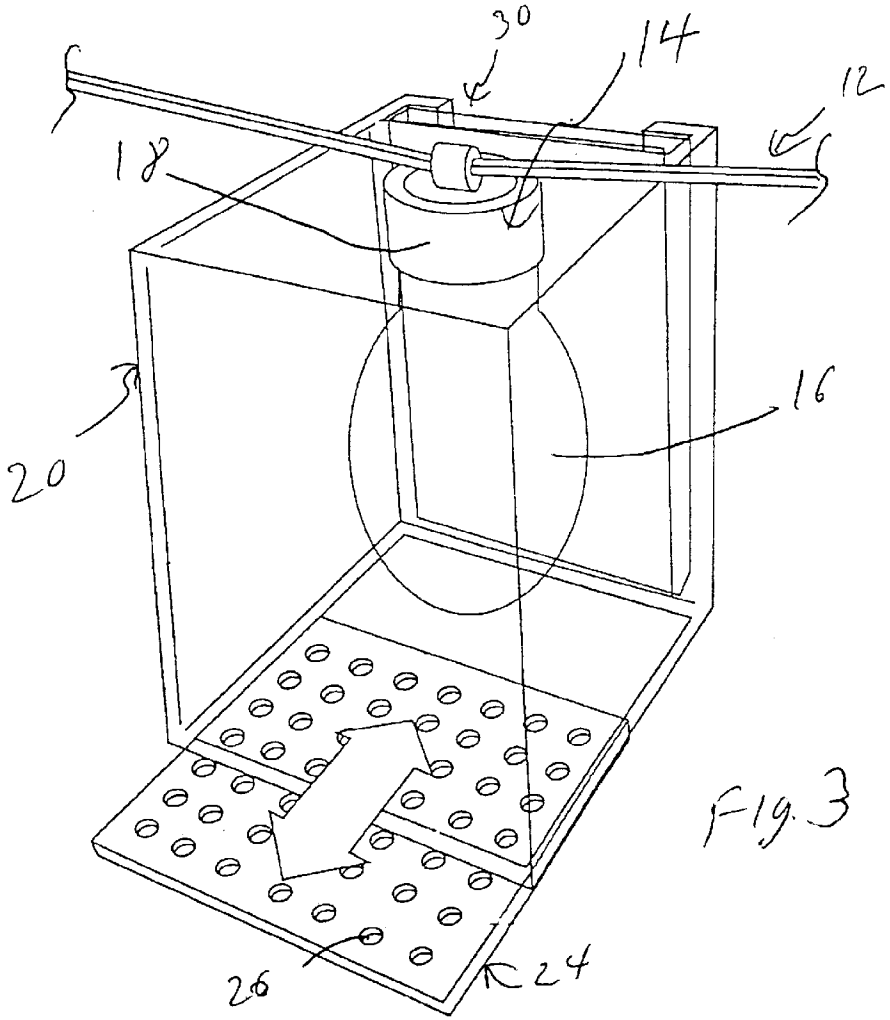
FIG. 3 is a detail perspective view of one of the multiple individual light bulb assemblies and light bulb housings of the light string of FIG. 1 showing the slide out bottom panel with airflow apertures and the transparency holding structure.
Figure 5:
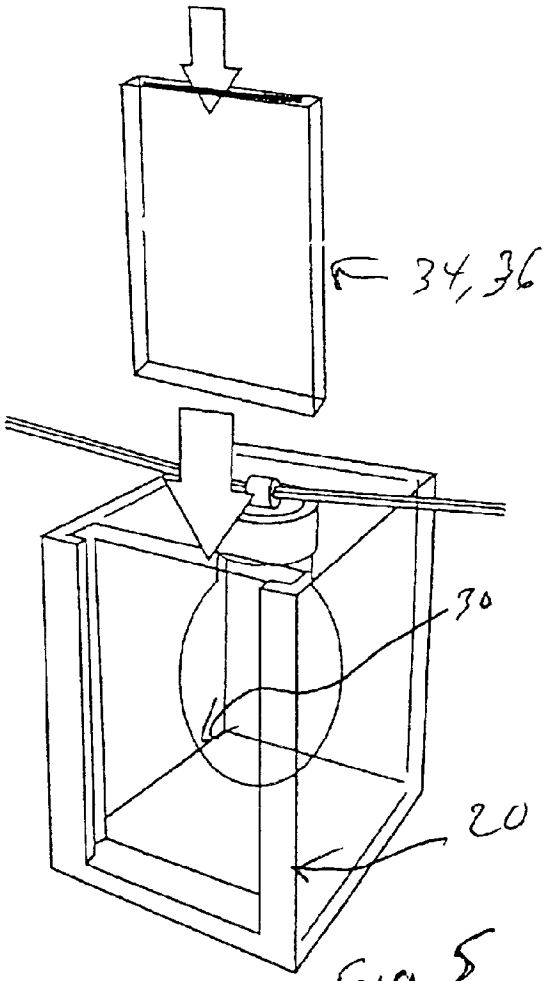
FIG. 5 is a detail perspective view of one of the multiple individual light bulb assemblies and the light bulb housings of the light string of FIG. 1 showing the transparency holding structure along with a representative transparency about to be slipped into the transparency holding structure.
Figure 4:
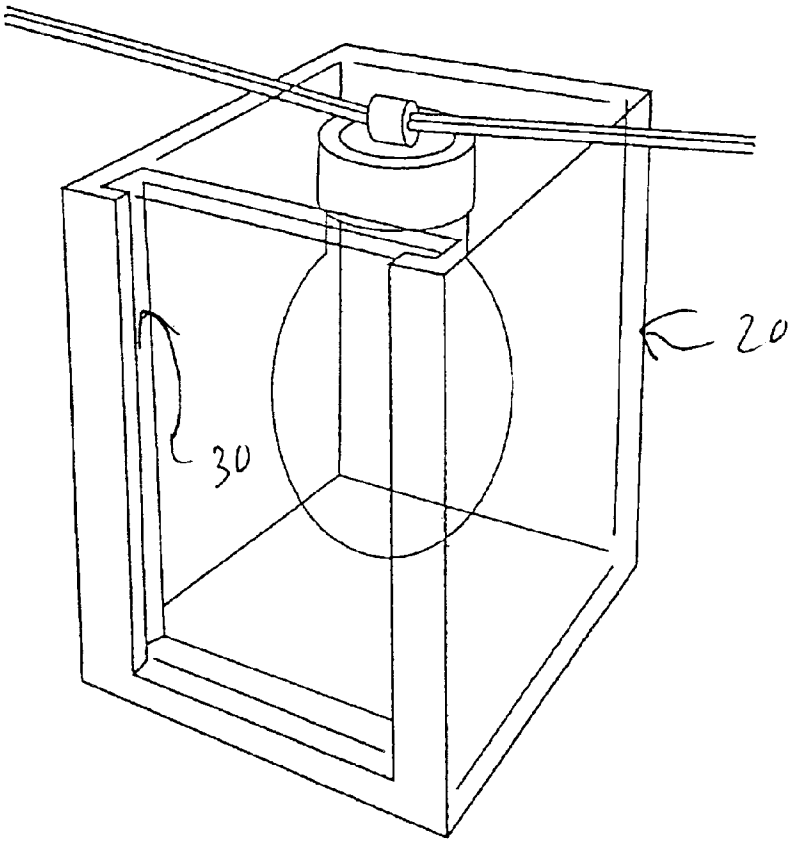
FIG. 4 is a detail perspective view of one of the multiple individual light bulb assemblies and the light bulb housings of the light string of FIG. 1 showing the transparency holding structure.

FIGS. 1–5 show various aspects of an exemplary embodiment of the light string with personalizable light covers of the present invention generally designated 10. Light string with personalizable light covers 10 includes a string of lights, generally designated 12 that includes multiple individual light bulb assemblies, generally designated 14, each including a light bulb 16 electrically connected to a light bulb socket 18 and having a light bulb housing, generally designated 20, secured over each light bulb assembly 14.

Each light bulb housing 20 has a slide out bottom panel, generally designated 24, provided with a number of airflow apertures 26. The airflow apertures help to keep the housing 24 cool. Slide out bottom panel 24 allows for the easy replacement of light bulbs 16 as needed.

Each light bulb housing 20 also includes a three-sided, picture frame style transparency holder, generally designated 30, that is adapted for holding one or more transparencies, such as color background transparencies 34 or decorative item transparencies 36. Transparency holder 30 holds the transparencies 34,36 such that light emitted from the light bulb 16 causes the transparencies 34,36 held in the transparency holder 30 to be illuminated.

It can be seen from the preceding description that a light string with personalizable light covers has been provided.

It is noted that the embodiment of the light string with personalizable light covers described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A light string with personalizable light covers comprising:

a strings of lights having multiple individual light bulb assemblies each including a light bulb electrically connected to a light bulb socket;

a light bulb housing secured over each light bulb assembly adapted to have a slide out bottom panel provided with airflow apertures therethrough for allowing cooling of the housing as well as allowing replacement of the light bulb therein as needed and having a transparency holder adapted for holding a transparency such that light emitted from the light bulb causes a transparency held in the transparency holder to be illuminated.

* * * * *